US006839996B2

(12) United States Patent
Kim

(10) Patent No.: US 6,839,996 B2
(45) Date of Patent: Jan. 11, 2005

(54) TRAFFIC SIGN DEVICE

(75) Inventor: Yong Soo Kim, Goyang (KR)

(73) Assignee: Hanyang Frame Co., Ltd., Gyeonggi-do (KR)

( * ) Notice: Subject to any disclaimer, the term of this patent is extended or adjusted under 35 U.S.C. 154(b) by 0 days.

(21) Appl. No.: 10/439,986

(22) Filed: May 15, 2003

(65) Prior Publication Data

US 2003/0213153 A1 Nov. 20, 2003

(30) Foreign Application Priority Data

May 20, 2002 (KR) ..... 10-2002-0027779
May 20, 2002 (KR) ..... 10-2002-0027777

(51) Int. Cl.[7] ..... G09F 15/00
(52) U.S. Cl. ..... 40/607.14; 40/612; 248/214; 248/218.4
(58) Field of Search ..... 40/607.14, 612, 40/572, 606.08, 610, 616; 248/214, 218.4, 219.3, 231

(56) References Cited

U.S. PATENT DOCUMENTS

| | | | | |
|---|---|---|---|---|
| 3,586,280 A | * | 6/1971 | Parduhn | 248/214 |
| 3,764,099 A | * | 10/1973 | Parduhn | 248/214 |
| 3,854,685 A | * | 12/1974 | Parduhn | 248/214 |
| 4,142,173 A | * | 2/1979 | Gould et al. | 248/214 |
| 4,246,715 A | | 1/1981 | Nelson | 40/607 |
| 4,342,168 A | | 8/1982 | Schmanski | 40/607 |
| 5,088,672 A | * | 2/1992 | Neuendorf et al. | 248/218.4 |
| 5,634,619 A | * | 6/1997 | Alessi | 248/219.3 |
| 5,974,712 A | | 11/1999 | Kallionpaa | 40/612 |

FOREIGN PATENT DOCUMENTS

| | | |
|---|---|---|
| JP | 7-317026 | 12/1995 |
| JP | 11-172639 | 12/1997 |
| JP | 10-168835 | 6/1998 |
| JP | 10-331118 | 12/1998 |
| JP | 2001-032225 | 2/2001 |
| JP | 2001-049628 | 2/2001 |
| KR | 1996-0009278 | 10/1996 |
| KR | 1998-0009420 | 4/1998 |
| KR | 20-0167877 | 11/1999 |
| KR | 20-0265849 | 2/2002 |

* cited by examiner

*Primary Examiner*—Lars A. Olson
(74) *Attorney, Agent, or Firm*—Sheridan Ross PC

(57) ABSTRACT

A traffic sign device is disclosed. The device includes a post clamp having at least two arched clamping bands, which are hingedly coupled to each other at their adjacent ends and joined to each other by a fastening element at their free ends to be installed on a post; a support bar having a socket pipe radially joined to an outer surface of one of the clamping bands, the socket pipe being axially provided with at least a joint hole, and a movable pipe slidably inserted into the socket pipe, the movable pipe being axially provided with a plurality of spaced holes in order to set the outward extent of the movable pipe; a sign board having an annular band frame with its peripheral edges being formed coupling grooves, and a front and rear covers with a skirt formed along the peripheral edge of the covers to be fitted into the coupling grooves; and a coupling unit for concentrically coupling the free end of the movable pipe to the center portion of the rear cover. The device allows the sign board to be easily installed on the post by a simple operation. As the sign board is formed into a drum shape, the coupling part behind the sign board is effectively shielded from a view. The invention ensures favorable appearance of the sign device as well as its extended service life.

13 Claims, 12 Drawing Sheets

- PRIOR ART -

- PRIOR ART -

TRAFFIC SIGN DEVICE

BACKGROUND OF THE INVENTION

1. Field of the Invention

The present invention relates to a traffic sign device installed on a roadside post to exhibit various restrictions, directions, and warning on the road for safety of traffic or to show information regarding street names or location of a destination for convenience of drivers or pedestrians, and more particularly to a structure of a traffic sign device which allows a sign board to be easily attached to a post and which improves durability of the sign device with an acceptable appearance.

2. Description of the Prior Art

In general, various road signs are installed on roadsides or above roads to show drivers and pedestrians information relating to a road and cautions in order to assure safety and smooth driving conditions, and which are further intended to provide drivers with information relating to use of a road to preserve the structure of the road.

Such a road sign is manufactured into a designated shape and size and installed according to the law so that the contents of the sign are shown in characters, signs, and a combination thereof.

Further, the road sign can be classified into three categories, that is, a cautionary sign which warns drivers and pedestrians of dangerous circumstances of a road and required precautions, a restrictive sign which forces them into a designated action, and a directive sign which notifies them of progressing direction or a distance to a destination, according to the nature of its communicative particulars.

Accordingly, the road sign should be installed properly to allow drivers and pedestrians to distinctly recognize its communicative information in the far distance and even at night.

Moreover, various road guide signs are installed on roadsides to show drivers and pedestrians information relating to a road, such as progressing direction of a road, a distance to a destination, and a destination point, for the drivers' and pedestrians' convenience.

According to the scale of a road, the above-mentioned road signs and road guide signs (hereinafter called "traffic sign") assume the form of monopole or double-pole support. The monopole type traffic sign is supported on a post in a roadside in a cantilever manner. The double-pole type traffic sign is supported on a horizontal bar laid across two posts that are set on both sides of the road. Usually, the monopole type traffic sign prevails over the double-pole type one except highway and freeway.

A conventional monopole type traffic sign device is shown in FIGS. 1A and 1B. A traffic sign board 3 is mounted on a cantilever beam or hanger 2 fixed to an upper part of a post "P". To this end, as shown in FIG. 1A, the sign board 3 has at its rear side a plurality of guide rails 4 attached thereto. The guide rails 4 are coupled to a vertical extension of the hanger 2 by inserting a head portion of a bolt 7 into the channel of the guide rail 4 and placing a U-shaped band 5 on both ends of the hanger extension to fasten the bolt 7 with a nut 8 at each flange 6 of the U-shaped band 5, as illustrated in FIG. 1*b*. The end of cantilever hanger 2 is fixed to a band clamp 1, so that the hanger 2 is horizontally supported on the post "P".

Such a structure of conventional traffic sign device can be found in Korean Laid-open Patent Publication No. 1999-79008 and Korean Registered Utility Model Publication No. 20-0195042.

However, since the conventional structure for supporting traffic sign has the guide rails 4 attached to the rear side of the sign board 3 and the U-shaped bands 5 for coupling the sign board to the hanger 2, the U-shaped bands 5 must be fastened by the bolts 7 and nuts 8 at both its ends after assembling the bolts 7 in the guide rails 4, an operation of establishing the traffic sign on the post "P" is considerably complicated.

Though the respective components are manufactured by iron material and then coated with paint, the components are apt to be oxidized and corroded due to aging of the paint at their coupled portions, thereby causing contamination of the post "P" and reduction of service life of the traffic sign.

Furthermore, since the sign board 3 is formed into thin plate and the assembly of the guide rails 4 and bolts 7 are exposed to the public, scenery of roads is significantly spoiled. Additionally, the sign board 3 is apt to be deformed due to its poor structural strength.

To overcome these problems of the conventional traffic sign device, various traffic sign devices are proposed in publications, for example, Korean Registered Utility Model Publication No. 1996-9278, Korean Laid-open Utility Model Publication No. 1998-9420, Korean Registered Utility Model Publication Nos. 20-0167877 and 20-0265849, and Japanese Laid-open Patent Publication No. H10-168835.

In the Korean Registered Utility Model Publication No. 1996-9278, a sign device has a pair of separate sign panels, made from plastic materials, each of the sign panels is provided with a boss and a protrusion to be fittingly coupled each other. An insertion boss is formed at one of the sign panels to be fitted in the top portion of a post.

Although this traffic sign device has advantages of easy installation operation, free from corrosion, and acceptable appearance, the sign panels are apt to be disassembled by an external force since they are assembled by a simple fitting operation. Therefore, the sign panel of the sign device is also apt to be deformed due to its poor structural strength.

In the Korean Laid-open Utility Model Publication No. 1998-9420, the sign device includes a first and second sign panels having a guide rail at their rear side. The guide rail is adapted to be coupled to a horizontal bar fixed to a post, by mean of a plurality of U-shaped bands.

On the other hand, the Korean Registered Utility Model Publication No. 20-0265849 and Japanese Laid-open Patent Publication No. H10-168835 disclose a sign device in which a sign board is provided at it rear side a separate cover for preventing exposure of the coupling part between the post hanger and the sign board.

However, since these sign boards must be fixed with relative to the post by means of the band and bolts, an operation of coupling the sign board on the post is considerably complicated. Also, in the case of the Korean Laid-open Utility Model Publication No. 1998-9420, since the bolt coupling parts of the sign board cannot be completely shielded by the cover, there still remains the problem of corrosion of the sign board components.

SUMMARY OF THE INVENTION

Accordingly, the present invention has been made keeping in mind the above problems occurring in the prior art, and an object of the present invention is to provide a traffic sign device which allows a sign board to be easily installed on a post, while minimizing the exposure of coupling part of the sign board.

Another object of the present invention is to provide a traffic sign device which improves structural strength of the sign board and enables efficient suppression of oxidization and corrosion of associated components, so as to permanently maintain its favorable appearance and to extend its service life.

A further object of the present invention is to provide a traffic sign device which allows a sign board to be easily and stably installed on a post, regardless of a size and a shape of the post.

In order to accomplish the above object, the present invention provides a sign device, which comprises: a post clamp including at least two arched clamping bands, which are hingedly coupled to each other at their adjacent ends and joined to each other by a fastening element at their free ends to be installed on a post; a support bar having a socket pipe radially joined to an outer surface of one of the clamping bands of the post clamp, the socket pipe being axially provided at its circumference with at least a joint hole, a movable pipe slidably inserted into the socket pipe, the movable pipe being axially provided at its circumference with a plurality of spaced adjustment holes, and a fastening means for coupling the movable pipe to the socket pipe through the joint hole and adjustment holes; a sign board having an annular band frame with its both peripheral edges being formed a coupling groove, and a front and rear covers having a skirt formed along the peripheral edge of the respective covers to be fitted into and fastened to the coupling groove of the band frame; and a coupling unit for fastening the free end of the movable pipe of the support bar to the center portion of the rear cover of the sign board.

In accordance with a preferred feature of this invention, the coupling unit includes: an inner mounting plate made of ferrous metal attached to an inner side of the rear cover, the inner mounting plate being provided at the side portions with a plurality of taps to be inserted into the rear cover and fixed thereon; an outer mounting plate made of nonferrous metal having a diameter somewhat larger than that of the movable pipe, the outer mounting plate being concentrically joined to the free end of the movable pipe; and a fastening means for coupling the outer mounting plate to the rear cover and inner mounting plate.

In accordance with another aspect of the present invention, the traffic sign device comprises: a post clamp having at least two arched clamping bands, which are hingedly coupled to each other at their adjacent ends and joined to each other by a fastening element at their free ends so as to be installed on a post; a support bar having a socket pipe radially joined to an outer surface of one of the clamping bands of the post clamp, the socket pipe being axially provided at its circumference with at least a joint hole, a movable pipe slidably inserted into the socket pipe, the movable pipe being axially provided at its circumference with a plurality of spaced adjustment holes, and a fastening means for coupling the movable pipe to the socket pipe through the joint hole and adjustment holes; a sign board having a skirt formed along the peripheral edge thereof, for exhibiting a road sign attached to the front surface thereof; and a coupling unit for fastening the free end of the movable pipe of the support bar to the center portion of the rear cover of the sign board, the coupling unit having a bracket formed into a pan shape and fixed to the rear center portion of the sign board by welding so as to form a space from the sign board, the bracket being provided with a coupling nut at the bottom portion thereof, a connecting plate having a diameter larger than that of the movable pipe of the support bar, the connecting plate being joined to the free end of the movable pipe by welding, and a fastening means for joining the bracket to the connecting plate.

In accordance with the preferred feature of this invention, the post clamp, the hanger and the sign board may be made of nonferrous metal excellent in corrosion resistance, such as aluminum and the like.

By the traffic sign device according to the present invention, a sign board is easily installed on a post by a simple operation of placing the post clamp on a post and joining the movable pipe fixed to the sign board into the socket pipe fixed to the post clamp, by bolts and nuts, an operation of installing the sign board is very much simplified.

Further, since the sign board is formed into a drum shape, and the joint portion relative to the support bar is positioned behind the sign board, the coupling part in the sign board is effectively prevented from a view. This structure allows the traffic sign device to have relatively good structural strength as compared to the prior art sign device, as well as an acceptable appearance for a long period of time, thereby contributing to visual improvement of the cityscape.

In addition, since associated components of the device are manufactured from nonferrous metal excellent in corrosion resistance, it is possible to prevent rusting and corrosion of the components, ensure favorable appearance of the structure, and extend a service life of the structure.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

This invention will be described in further detail by way of exemplary embodiments with reference to the accompanying drawings.

Referring to FIGS. 2 to 8 of the drawings, there is shown a traffic sign device according to one embodiment of the present invention.

As shown in FIGS. 2 to 5, the traffic sign device includes a post clamp 10 mounted on a post "P" perpendicularly installed on a roadside, a support bar 20 radially coupled to an outer surface of the post clamp 10 to be horizontally positioned, a sign board 30 fixed to free end of the support bar 20 for exhibiting a desired road sign, and a coupling unit 50 for concentrically joining the support bar 20 to the rear side of the sign board 30.

Figure 1A:
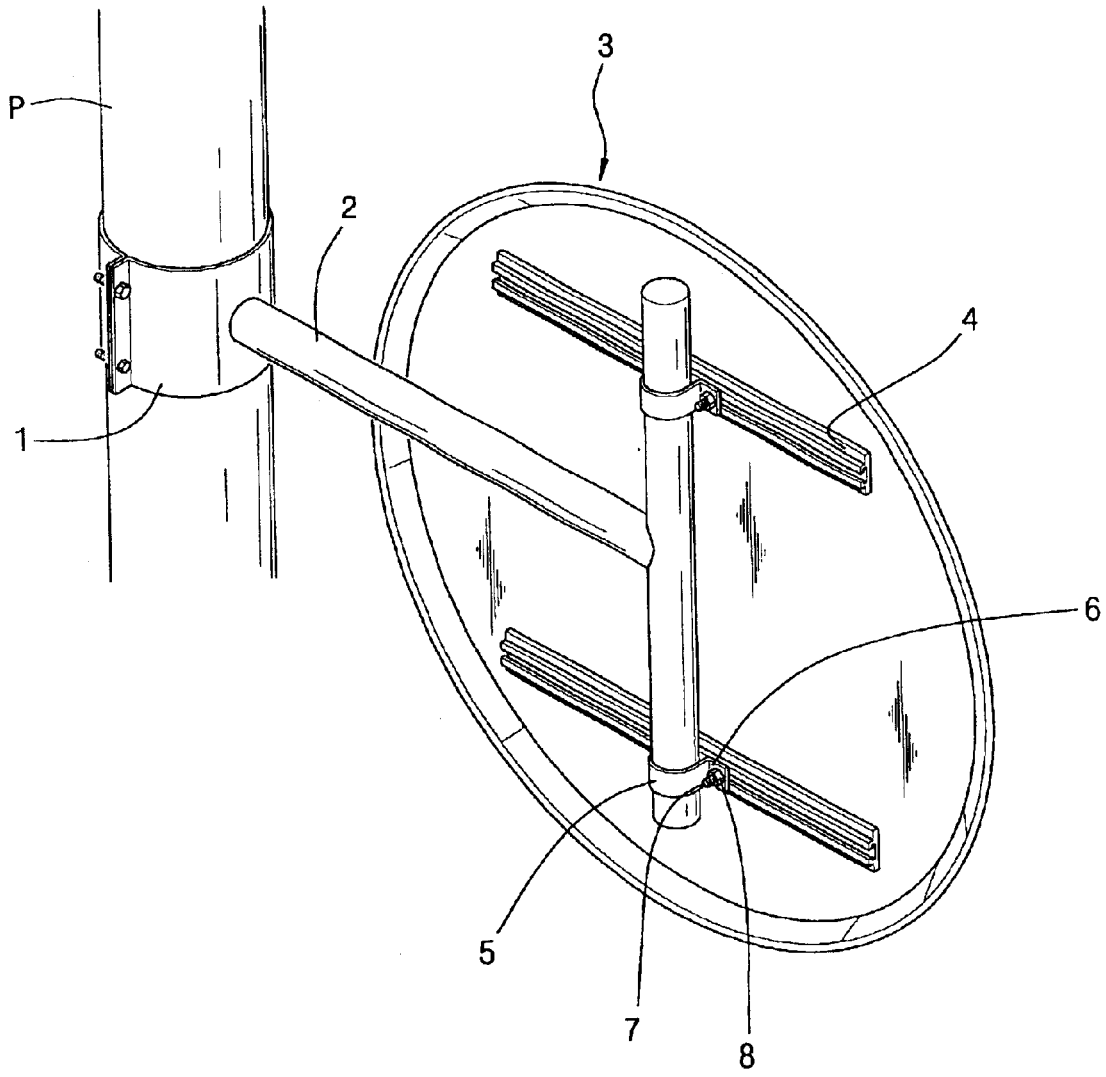
FIG. 1A is a perspective view of a conventional traffic sign device.
Figure 1B:
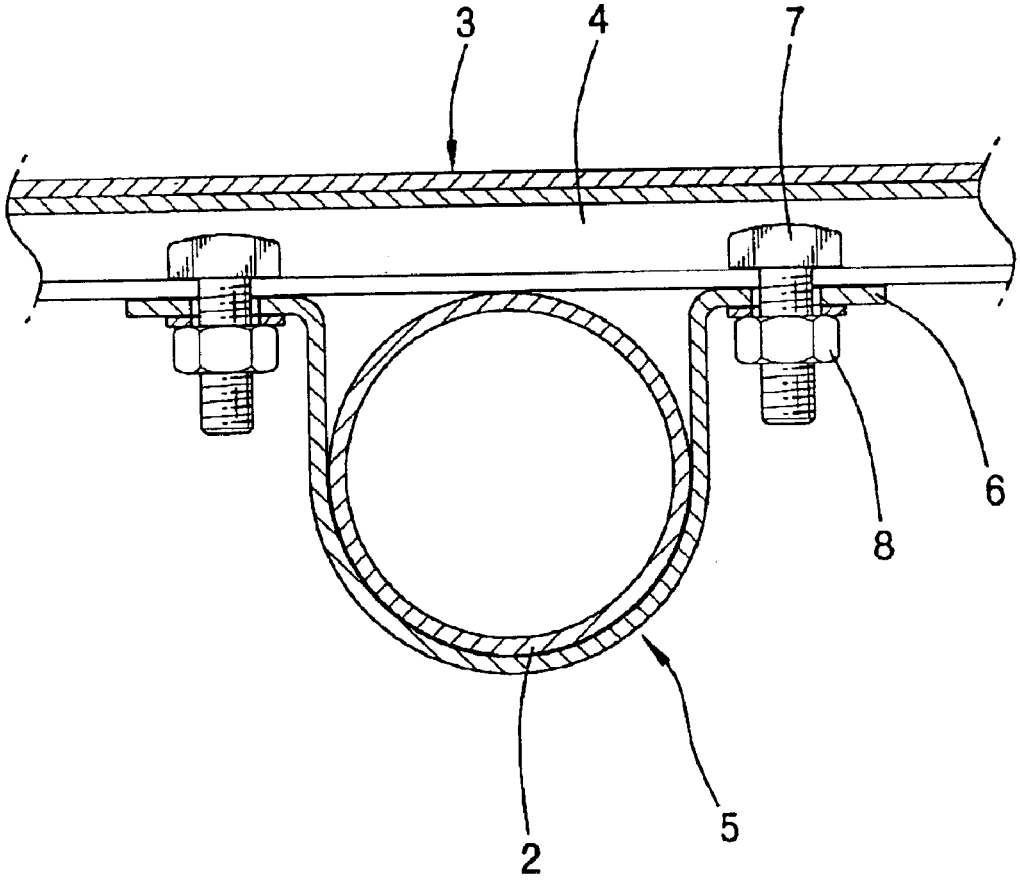
FIG. 1B is a plan cross-sectional view of the conventional traffic sign device of FIG. 1A, which is partially taken to illustrate coupling part of a sign board.
Figure 2:
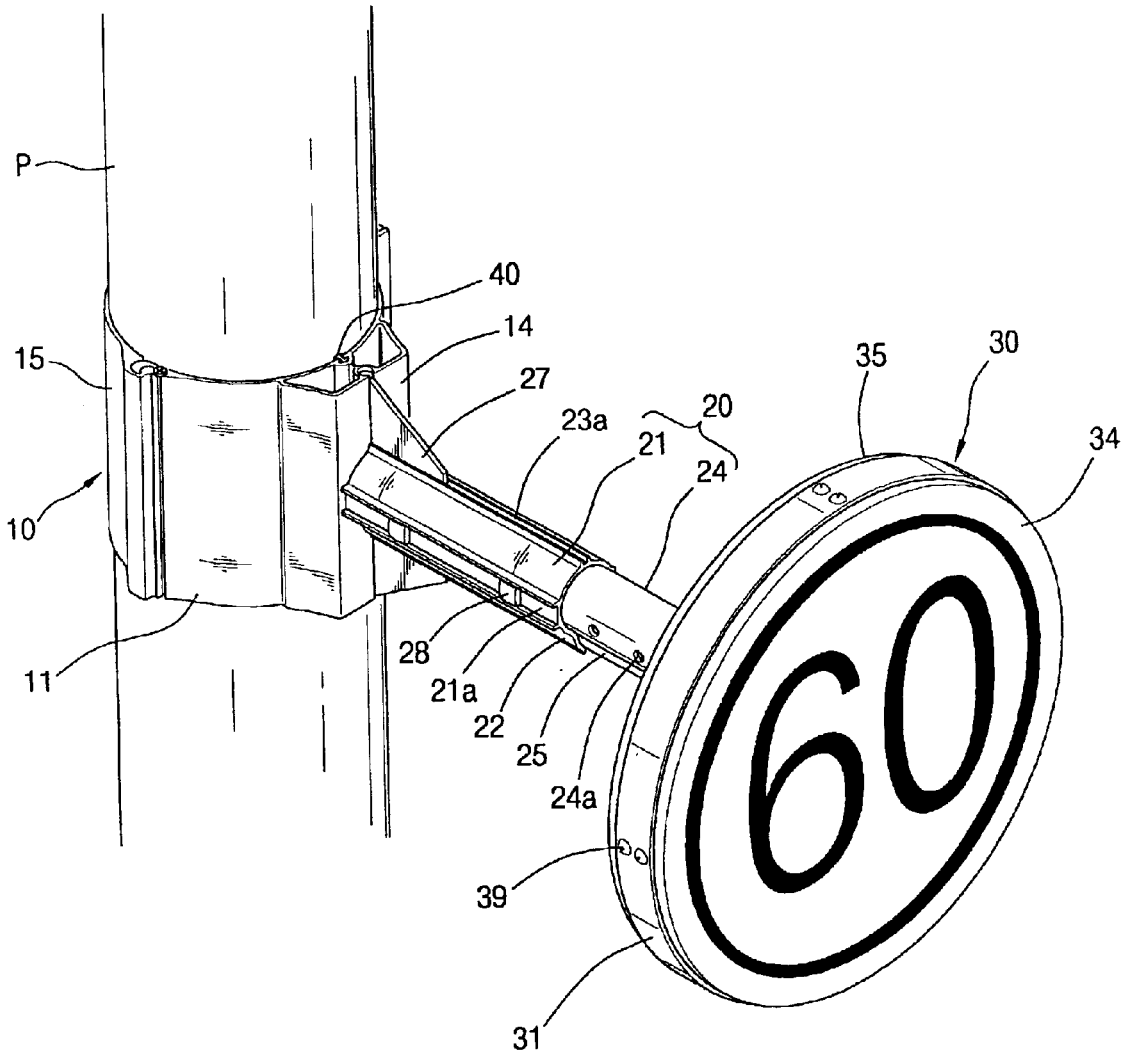
FIG. 2 is a perspective view of a traffic sign device according to one embodiment of the present invention, which is installed on a post.
Figure 3:
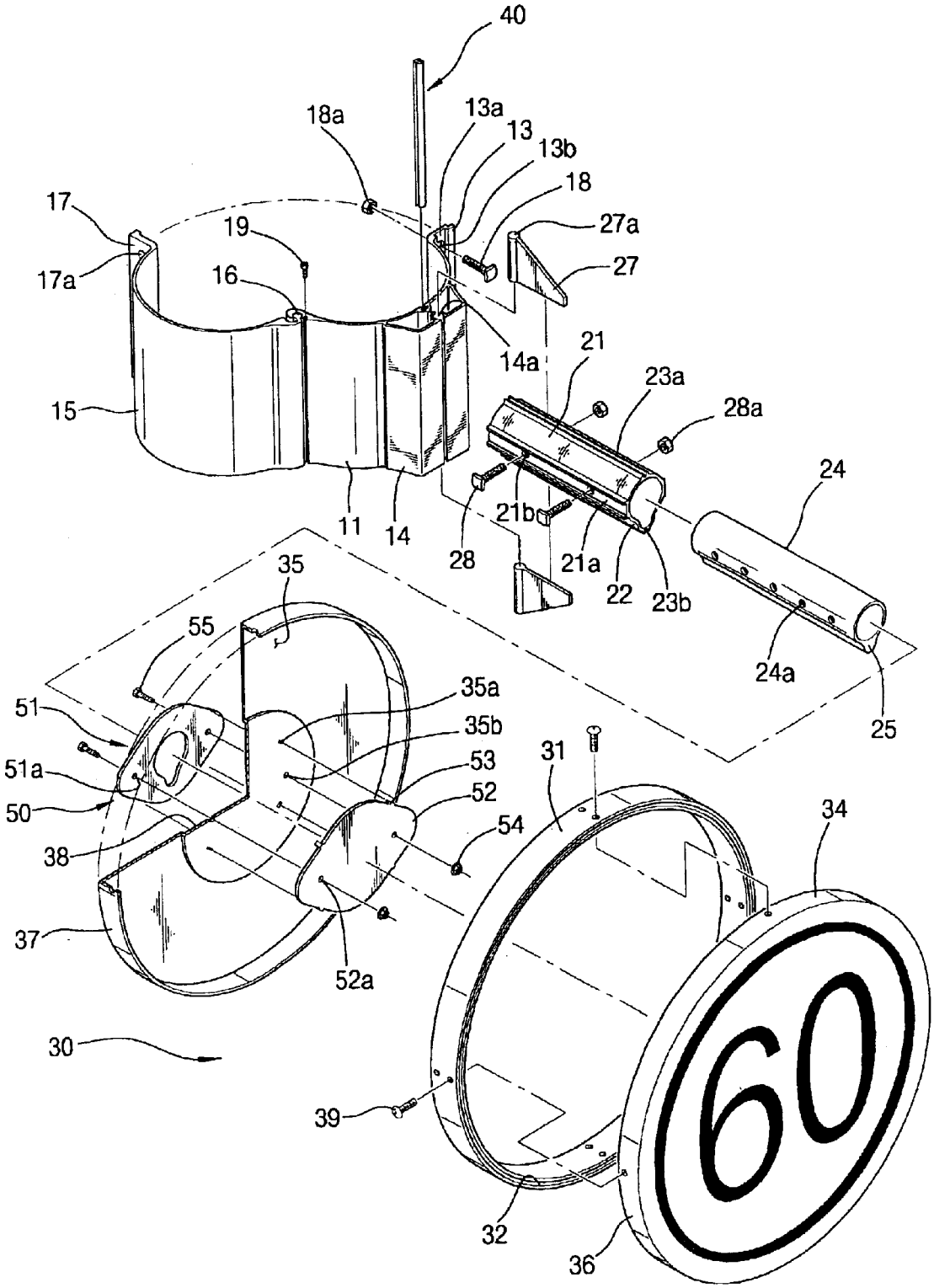
FIG. 3 is an exploded perspective view of the traffic sign device according to one embodiment of the present invention.
Figure 5:
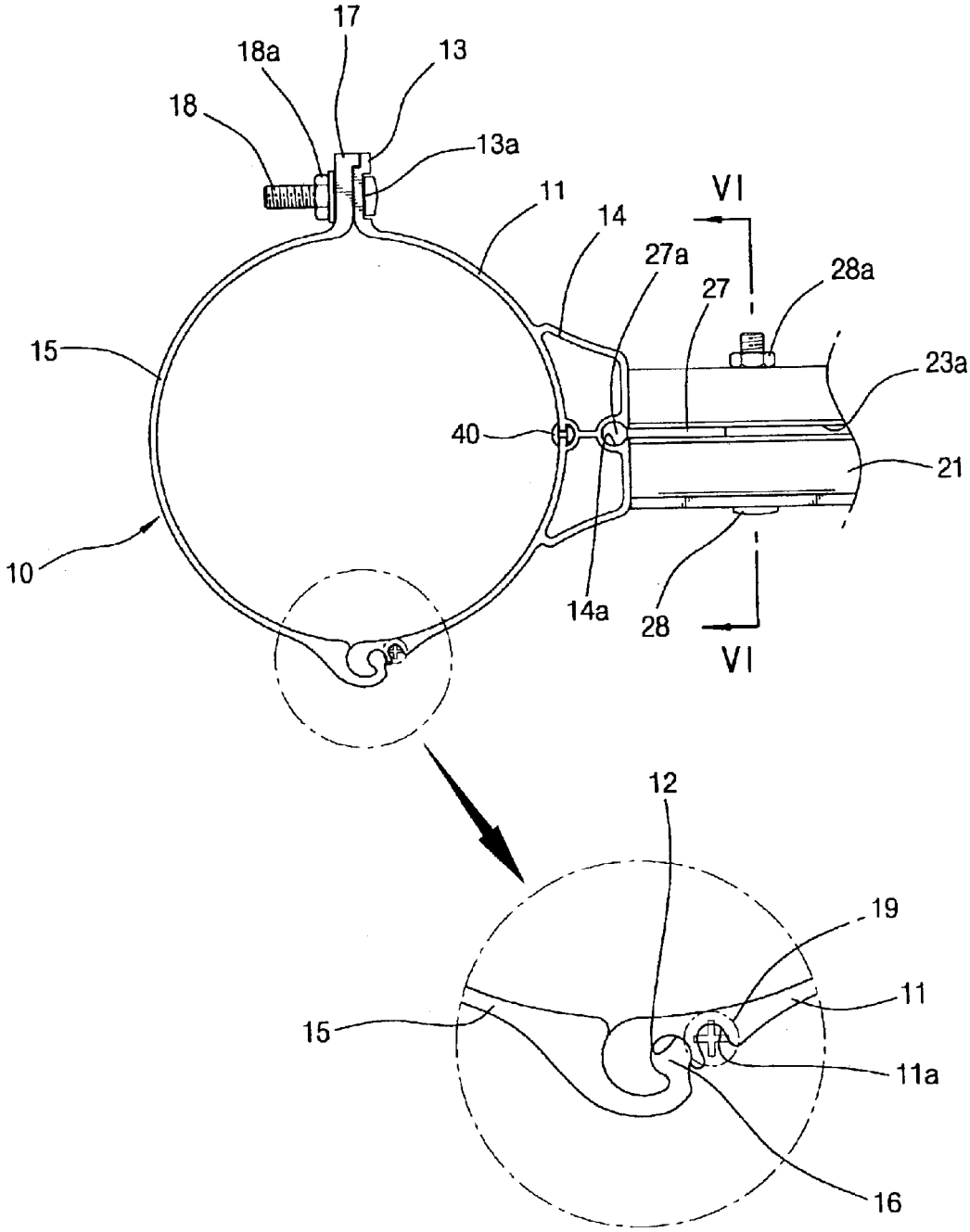
FIG. 5 is a plan view taken from the direction V of FIG. 4, which is partially enlarged.

The post clamp 10 includes a pair of semicircular clamping bands 11 and 15, which is hingedly coupled to each other at their ends and fastened by bolts 18 and nuts 18*a* at their other ends, as illustrated in FIGS. 3 and 5.

As shown in detail in FIG. 5, the first clamping band 11 is provided at its end with a hinge groove 12 having a C-shaped cross section. The first clamping band 11 is further provided adjacent to the hinge groove 12 with a screw groove 11*a* having a C-shaped cross section, so that the screw groove 11*a* is engaged with retaining screws 19 at both ends to prevent separation of the second clamping band 15 from the hinge groove 12. More specifically, since the retaining screws 19 are partially embedded in the hinge groove 12 at their head portions, a hinge bulge 16 of the second clamping band 15 cannot be separated from the hinge groove 12.

Further, the first clamping band 11 is provided at the other end with a flange 13 having a plurality of joint holes 13*b* (See FIG. 3). The flange of the first clamping band 11 is provided at its outer surface with a channel-shaped bolt head seat 13*a*, as shown in detail in FIG. 5, to prevent rotation of the head of bolts 18 inserted through the joint holes 13*b*.

Furthermore, the first clamping band 11 is provided at the center of its outer surface with a support land 14 protruded therefrom. This support land 14 is integrally formed with the first clamping band 11 to connect one end of the support bar 20 thereto and support the support bar 20. The center of the support land 14 is longitudinally provided with a coupling groove 14*a* having a C-shaped cross section to receive a pair of reinforcing ribs 27 (described hereinafter) thereinto.

Lastly, referring to FIG. 3, the first clamping band 11 is longitudinally provided at the center of its inner surface with a slit 11*b*, in which a rod-shaped contacting insert 40 is mounted to resiliently compress the post "P" when two clamping bands 11 and 15 are clamped around the post. The contacting insert 40 is provided against movement or rotation of the post clamp 10 due to possible gap between the post clamp 10 and the post "P" occurring when the post is formed into a square shape.

Accordingly, configuration of the contacting insert 40 can be selected according to the shape of the post "P" in a detachable manner. In the case of a cylindrical post, even the diameter of the post clamp 10 is slightly larger than that of the post "P", the contacting insert 40 enables the post clamp 10 to be stably fixed to the post. Such a contacting insert is preferably manufactured from resilient material having a proper elasticity, such as India rubber and polyurethane.

The second clamping band 15 is provided at its end with the hinge bulge 16, which is fitted into the hinge groove 12 of the first clamping band 11, and is provided at the other end with a flange 17 having a plurality of joint holes 17*a*.

Although not shown in the drawings, the second clamping band 15 may have at its circumferential surface a slit similar to that of the first clamping band 11 so that the contacting insert 40 can be detachably mounted thereto, if necessary.

The above post clamp 10 is preferably manufactured from nonferrous metal excellent in corrosion resistance, such as aluminum material, by an extrusion process.

Turning to FIG. 3, the support bar 20 includes a socket pipe 21 joined to the support land 14 of the post clamp 10 by welding, and a movable pipe 24 slidably inserted into the socket pipe 21 and coupled thereto by bolts 28 and nuts 28*a*.

Figure 6:
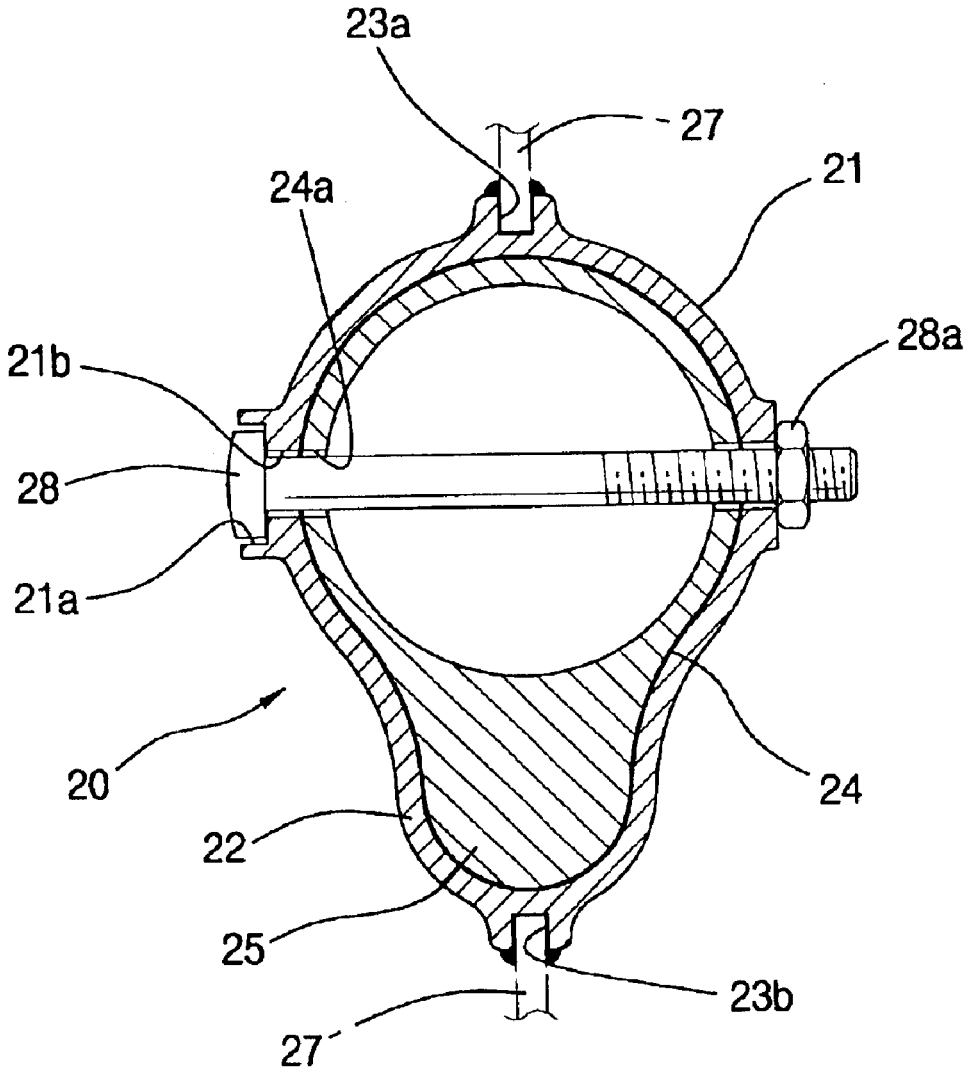
FIG. 6 is a cross-sectional view taken along line VI—VI of FIG. 5.

The socket pipe 21 is provided at its inner surface with a key channel 22 and the movable pipe 24 is provided at its outer surface with a key ridge 25 corresponding to the key channel 22, so that a position of the movable pipe 24 relative to the socket pipe 21 is established and a relative rotation between the socket pipe 21 and the movable pipe 24 is prevented, as illustrated in FIG. 6.

The socket pipe 21 is axially provided at its outer surface with a channel-shaped bolt head seat 21*a* so as to prevent bolt heads 28 seated in the bolt head seat 21*a* from being rotated. The bolt head seat 21*a* includes two spaced joint holes 21*b*, so that bolts 28 are radially inserted into the joint holes 21*b*.

Preferably, a pair of reinforcing ribs 27 is coupled to the upper and lower sides of the socket pipe 21 so as to more stably support the socket pipe 21 welded to the support land 14 of the post clamp 10.

Each of the reinforcing rib 27 is provided at its one edge with an enlarged coupling bulge 27*a*, which is fitted into a coupling groove 14*a* formed on the support land 14. The horizontal side of each reinforcing rib 27 is engaged with upper and lower support grooves 23*a* and 23*b*, which are axially formed on upper and lower surfaces of the socket pipe 21, and then fixed thereto by welding (denoted as black dots in FIG. 6).

The movable pipe 24 is sized to be relatively long comparing with the socket pipe 21, and is provided with a plurality of spaced joint holes 24*a* corresponding to the joint holes 21*b* of the socket pipe 21. With this, the extent of the support bar 20 can be adjusted by changing the position of the movable pipe 24 relative to the socket pipe 21.

Also, the support bar 20 is preferably manufactured from nonferrous metal excellent in corrosion resistance, such as aluminum material, by an extrusion process.

Figure 7:
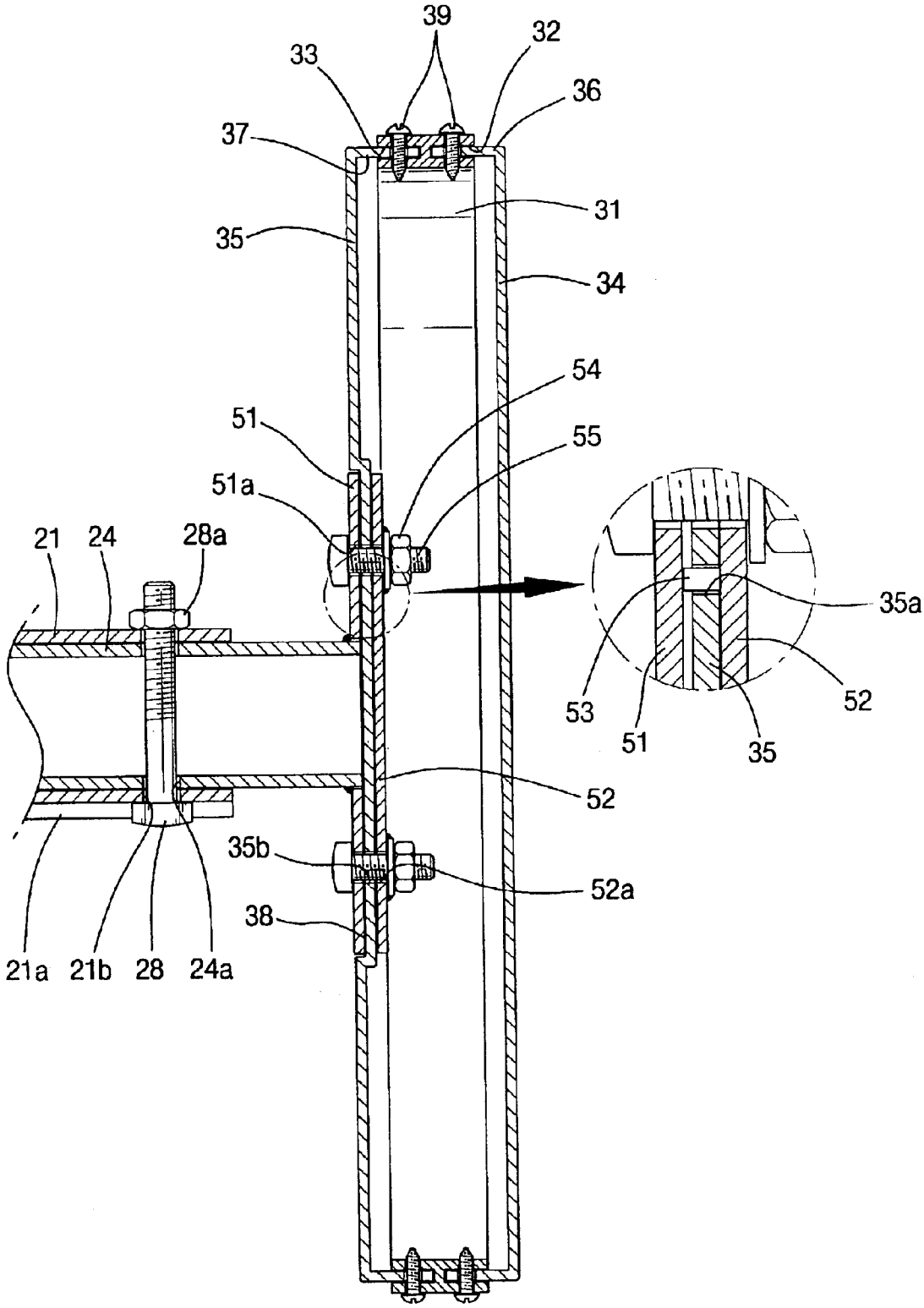
FIG. 7 is a partial cross-sectional view taken along line VII of FIG. 4.
Figure 8:
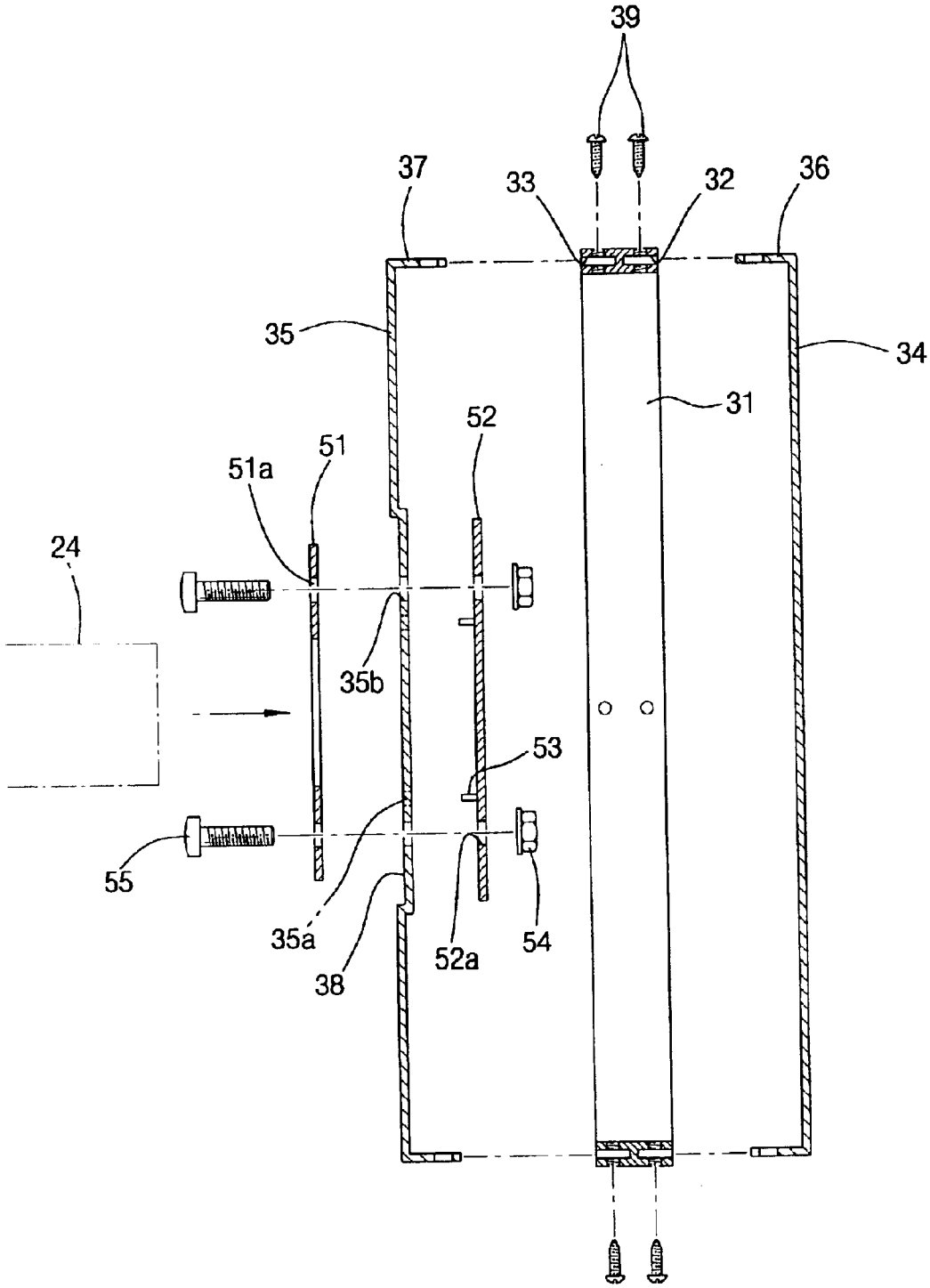
FIG. 8 is an exploded plan cross-sectional view showing assembling procedure of the sign board shown in FIG. 7.

Referring to FIGS. 3, 7 and 8, there are shown a sign board in accordance with the present invention. The sign board 30 comprises an annular band frame 31 and a front and rear cover 34 and 35, attached to both sides of the band frame 31.

Though the shape of band frame 31 and the corresponding front and rear cover 34, 35 are illustrated in the drawing as circular, they may be formed into any shape, such as a circle, a triangle, and a quadrangle, according to a kind of road sign stipulated in road safety rules.

The band frame 31 is provided at its both peripheral edges with a coupling groove 32 and 33, into which a skirt 36 and 37 of the front cover 34 and rear cover 35, respectively, are forcibly fitted to couple the front and rear cover 34 and 35 to the band frame 31.

The front cover 34 is formed to have a plane plate with the skirt 36 formed along its peripheral edge, so that a road sign may be printed or attached to the outside of the cover. The skirt 37 of the rear cover 35 is also formed along the peripheral edge of the rear cover 35.

The band frame 31 is also provided around its circumferential edge a plurality of mounting holes, to which a screw 39 is fixed through the skirt 36, 37 of the front and rear cover when the skirt 36, 37 are fitted into both coupling grooves 32, 33 of the band frame 31.

Alternatively, the front and rear cover may be fixedly joined to the band frame 31 by a welding process, instead of the screw.

The rear cover 35 is provided at the center portion thereof with a circular depression 38 so as to safely receive an outer mounting plate 51 of the coupling unit 50 which will be described hereinafter. The depression 38 is formed by means of a drawing process, and a plurality of mounting slots 35*a* and a pair of mounting holes 35*b* are formed on the bottom surface of the depression 38 so as to join the coupling unit 50 thereto.

The band frame 31 and covers 34 and 35 are preferably made of nonferrous metal excellent in corrosion resistance, such as aluminum and the like.

The sign board 30 is connected to the support bar 20 through the coupling unit 50. As illustrated in FIGS. 3 and 7, the coupling unit 50 includes an outer mounting plate 51 and an inner mounting plate 52. The outer mounting plate 51 is concentrically fixed to the free end of the movable pipe 24 of the support bar 20, by a welding process. Preferably, a coupling hole is formed at the center portion of the outer mounting plate 51 to fit with the free end of the movable pipe 24 so as to increase joining force at the welding point.

The inner mounting plate 52 is attached to the rear side of the rear cover 35, exactly the part behind the depression 38.

The outer mounting plate 51 is made of nonferrous metal excellent in corrosion resistance, having a diameter somewhat larger than that of the movable pipe 24.

A pair of mounting holes 51*a* is formed at either side portions of the outer mounting plate 51 to face to the mounting holes 35*b* of the rear cover 35. Also, a pair of mounting holes 52*a* is formed at either side portions of the inner mounting plate 52 to face to the mounting holes 35*b* of the rear cover 35.

After the center portion of the outer mounting plate 51 is joined to the free end of the movable pipe 24, by welding, the outer and inner mounting plate 51, 52 are coupled to each other by using a bolt 55 and a nut 54, through the mounting holes 51*a* and 52*a*, interposing the mounting holes 35*b* of the rear cover 35. Each coupling portion around the nut 54 is preferably welded on the surface of the inner mounting plate 52, to secure it from loosening.

The inner mounting plate 52 is manufactured from iron plate, by pressing. Preferably, the inner mounting plate 52 is provided at every side portions a plurality of taps 53, to be inserted into the corresponding mounting slots 35*a* formed in the rear cover 35. Excess portion of inserted tap 53 is bent over the rear cover 35, and the attachment operation of the inner mounting plate 52 to the rear cover 35 is accomplished.

An operation of installing the sign device to the post by the structure according to the present invention will now be described.

First, the traffic sign device is manufactured into two unit assemblies including the post clamp 10 and the sign board 30. In the first assembly, the socket pipe 21 of the support bar 20 is joined to the support land 14 of the post clamp 10 by welding process. In the second assembly, the movable pipe 24 of the support bar 20 is joined to the sign board 30 by means of the coupling unit 50, as described above.

Figure 4:
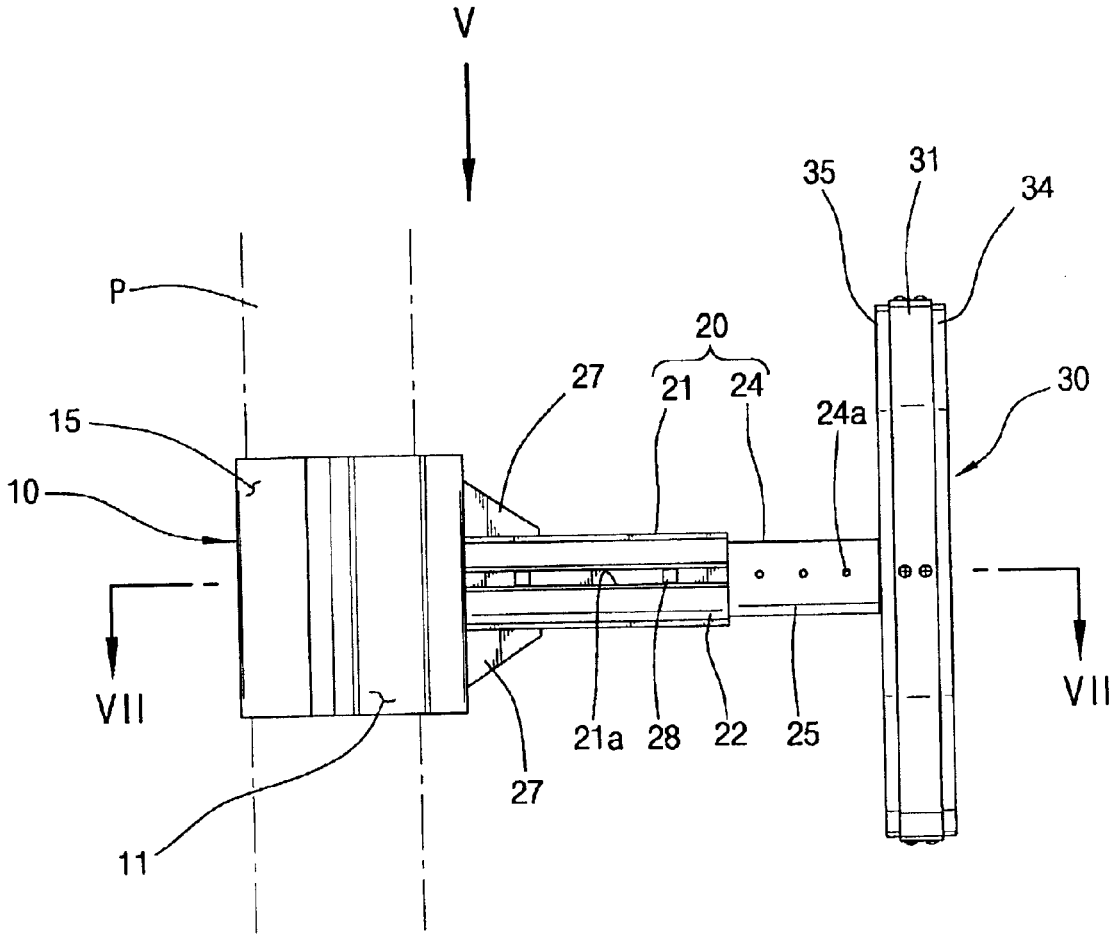
FIG. 4 is a side elevation view of the traffic sign device, which illustrates assembled state of the sign device shown in FIG. 3.

Accordingly, after transportation of the two unit assemblies to an installation site, the installing operation can be easily accomplished by coupling the post clamp 10 to a post, simply inserting the movable pipe 24 fixed to the sign board 30 into the socket pipe 21 joined to the post clamp 10, and positioning the movable pipe 24 to have a desired extension by fastening the bolts 28 and nuts 28*a* on the socket pipe 21, as shown in FIG. 4.

With the above-mentioned structure, since the post clamp 10 is comprised of two arched clamping bands 11, 15 hingedly coupled to each other, the post clamp 10 is easily installed on the post, and thus the sign board can be more easily installed on the post. Also, in consideration of a road circumstances, the fixing position of the movable pipe 24 relative to the socket pipe 21 is adjusted to allow the sign board 30 to have an optimum viewing position.

Particularly, since the sign board 30 is formed into a drum shape, and the outer mounting plate 51 of the coupling unit 50 is positioned around the depression 38, the coupling part of the sign board 30, the exposure of the coupling part, behind the sign board 30 is effectively minimized, except for head portion of the bolts 55. This allows the traffic sign device to have excellent structural strength enough to resist flexure and deformation due to external force, and to have an acceptable appearance for a long period of time, thereby contributing to visual improvement of the cityscape.

Further, since components of the traffic sign device of this invention is manufactured from rust-resistant materials, the sign device can permanently preserve its original adaptable appearance without needing subsequent painting, and its reparability and service life are considerably improved.

Figure 9:
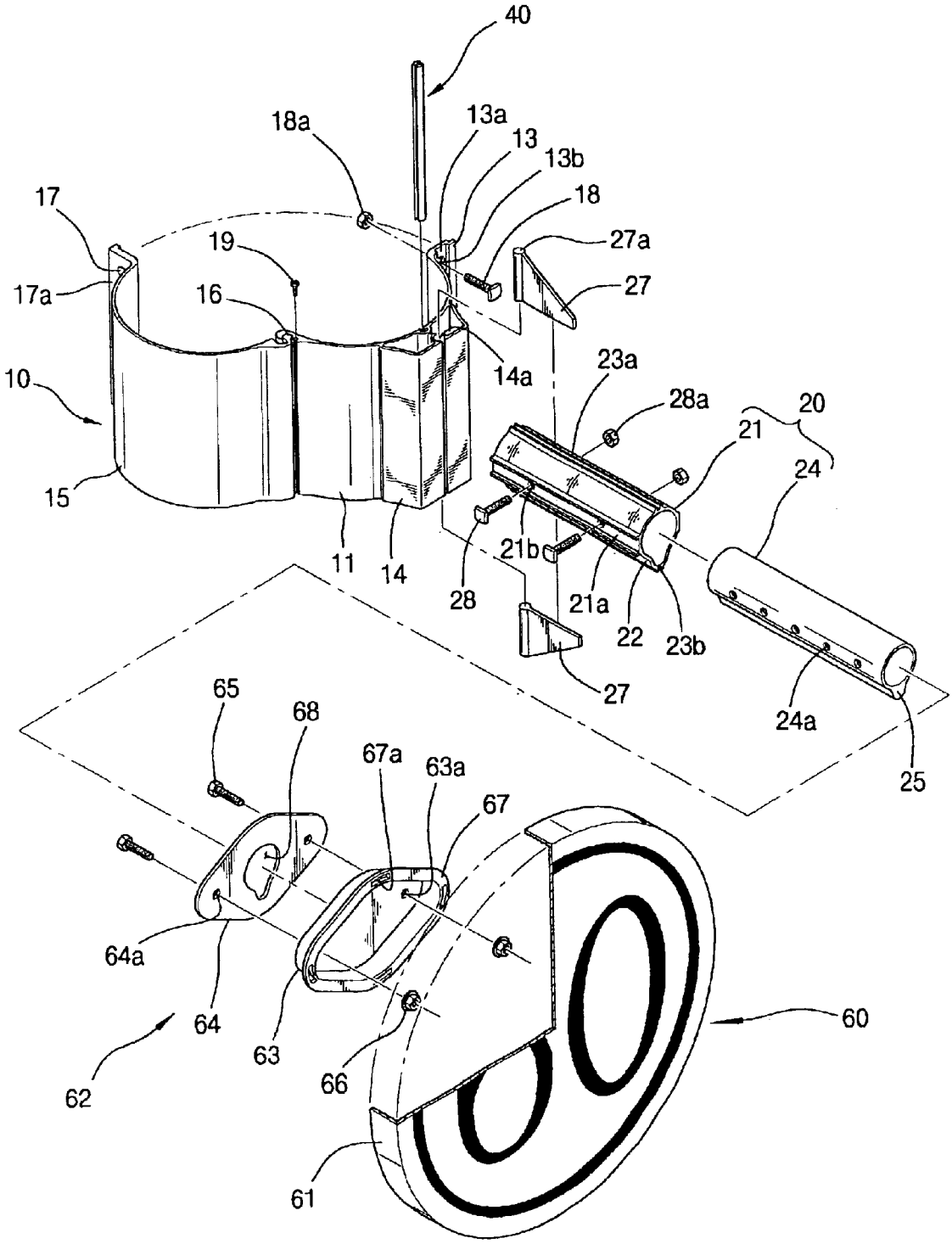
FIG. 9 is an exploded perspective view of a traffic sign device according to another embodiment of the present invention.
Figure 10:
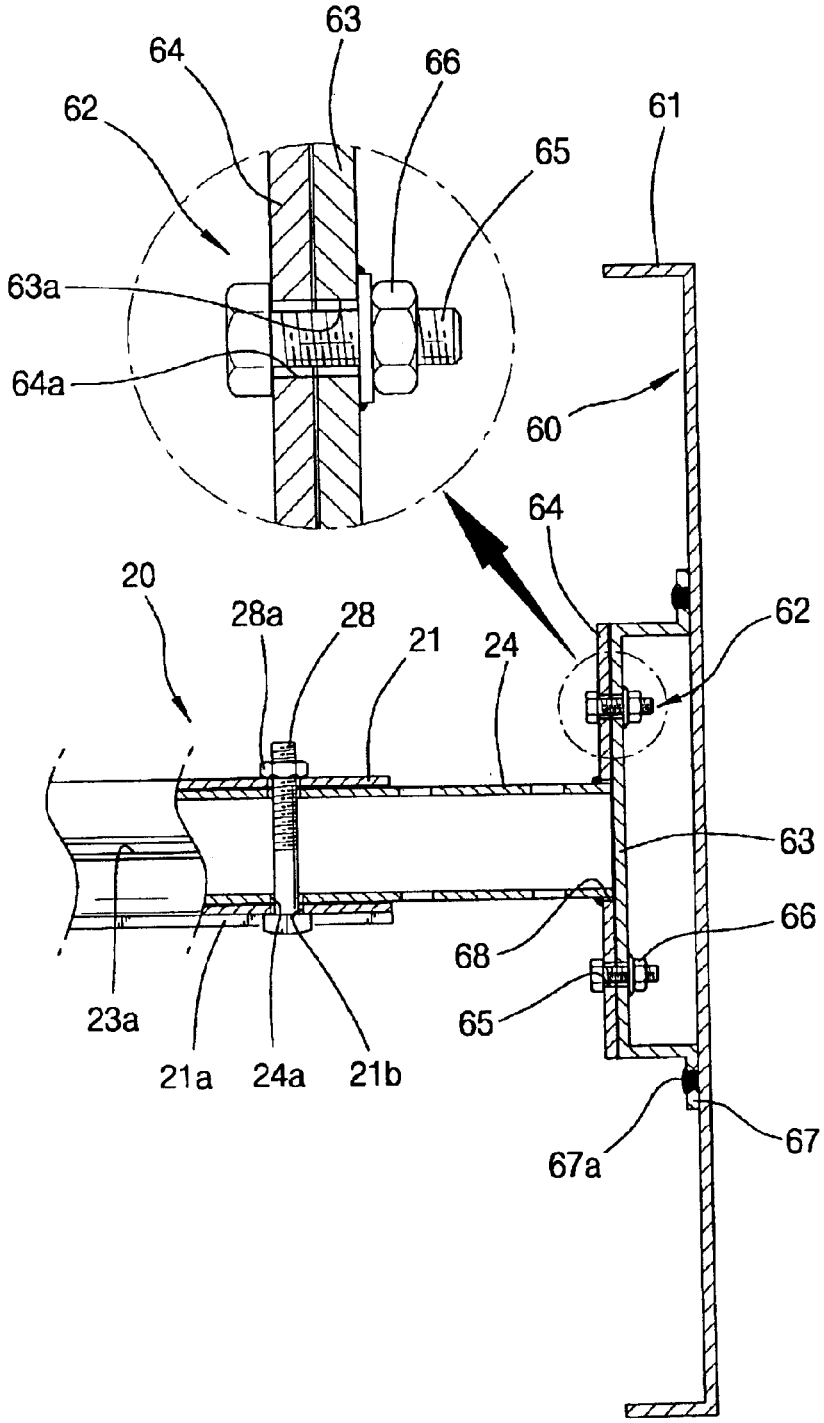
FIG. 10 is a plan cross-sectional views showing assembled state of the sign device shown in FIG. 9.

Referring again to FIG. 9 to FIG. 10 of the drawings, there is shown a second embodiment of the traffic sign device according to the present invention.

Similar to the first embodiment, the traffic sign device includes a post clamp 10 mounted on a post "P", a support bar 20 radially joined to an outer surface of the post clamp 10 to be horizontally positioned, a sign board 60 mounted on free end of the support bar 20 to exhibit a road sign, and a coupling unit 62 for connecting the sign board 60 to the support bar 20.

In this embodiment, since the configuration of the post clamp 10 and the support bar 20 is exactly same as those of the first embodiment, the details will be omitted for brevity's sake by denoting the same components by the same reference number.

The sign board 60 is formed into a single plane plate having a skirt 61 inwardly extended at a desired width. The skirt 61 is intended to increase the structural strength of the sign board 60 and to properly shield the exposure of the coupling unit 62 joined to the backside of the sign board 60.

This sign board 60 is also made of nonferrous metal excellent in corrosion resistance, such as aluminum and the like, and formed into any shape, such as a circle, a triangle, and a quadrangle, according to a kind of road sign stipulated in road safety rules. In the drawings, the sign board 60 is depicted to have a circular plate, for example.

The coupling unit 62 is comprised of a bracket 63 fixed to the rear center portion of the sign board 60, preferably by welding, a connecting plate 64 fixed to the free end of the movable pipe 24 of the support bar 20 by welding, and a fastening means for joining the bracket 63 to the connecting plate 64.

The bracket 63 is made of nonferrous metal, such as aluminum and the like, and formed into a pan shape with a flange 67 provided around its opening portion. With this, there is provided a space between the sign board 60 and the bracket 63. The bracket 63 is provided at bottom surface thereof with a pair of mounting holes 63*a*, to which a coupling nut 66 is concentrically fixed, by welding, so that a bolt 65 is fastened thereto. Alternatively, a bolt may be welded in the opposite direction so that the nut is fastened from the outside of the bracket 63.

Also, the bracket 63 is provided along the width of flange 67 with a welding slot 67*a*, at a desired interval, so that the bracket 63 is more stably welded to the rear surface of the sign board 60, as compared to the welding at the periphery of the flange 67.

The connecting plate 64 is made of nonferrous metal, such as aluminum and the like, to have a diameter larger than that of the movable pipe 24 of the support bar 20. At the center portion of the connecting plate 64, a coupling hole 68 is formed to fit with the free end of the movable pipe 24. Also, at either side portions of the connecting plate 64, a pair of mounting holes 64*a* is formed to face to the mounting holes 63*a* of the bracket 63.

With this, when the bracket 63 is fixed to the sign plate 60 by welding, the coupling nut 66 is concealed from an outside view, which results in a favorable appearance.

The sign board 60 is coupled to the support bar 20 into an assembly by simply mating the bracket 63 of the sign board 60 with the coupling plate 64 joined to the movable pipe 24 of the support bar 20, and fastening a pair of bolts 65 onto the mounting holes 64*a* of the coupling plate 64, which is in line with the coupling nuts 66 of the bracket 63.

Similar to the above-mentioned first embodiment, the sign device of the second embodiment is manufactured into two unit assemblies including the post clamp 10 and the sign board 60. In the first assembly, the socket pipe 21 of the support bar 20 is joined to the support land 14 of the post clamp 10 by welding process. In the second assembly, the movable pipe 24 of the support bar 20 is joined to the sign board 60 by means of the coupling unit 62, as described above.

Thus, after transportation of the two unit assemblies to an installation site, the installing operation can be easily accomplished by coupling the post clamp 10 to a post, simply inserting the movable pipe 24 fixed to the sign board 60 into the socket pipe 21 joined to the post clamp 10, and positioning the movable pipe 24 to have a desired extension by fastening the bolts 28 and nuts 28*a* on the socket pipe 21.

Figure 11:
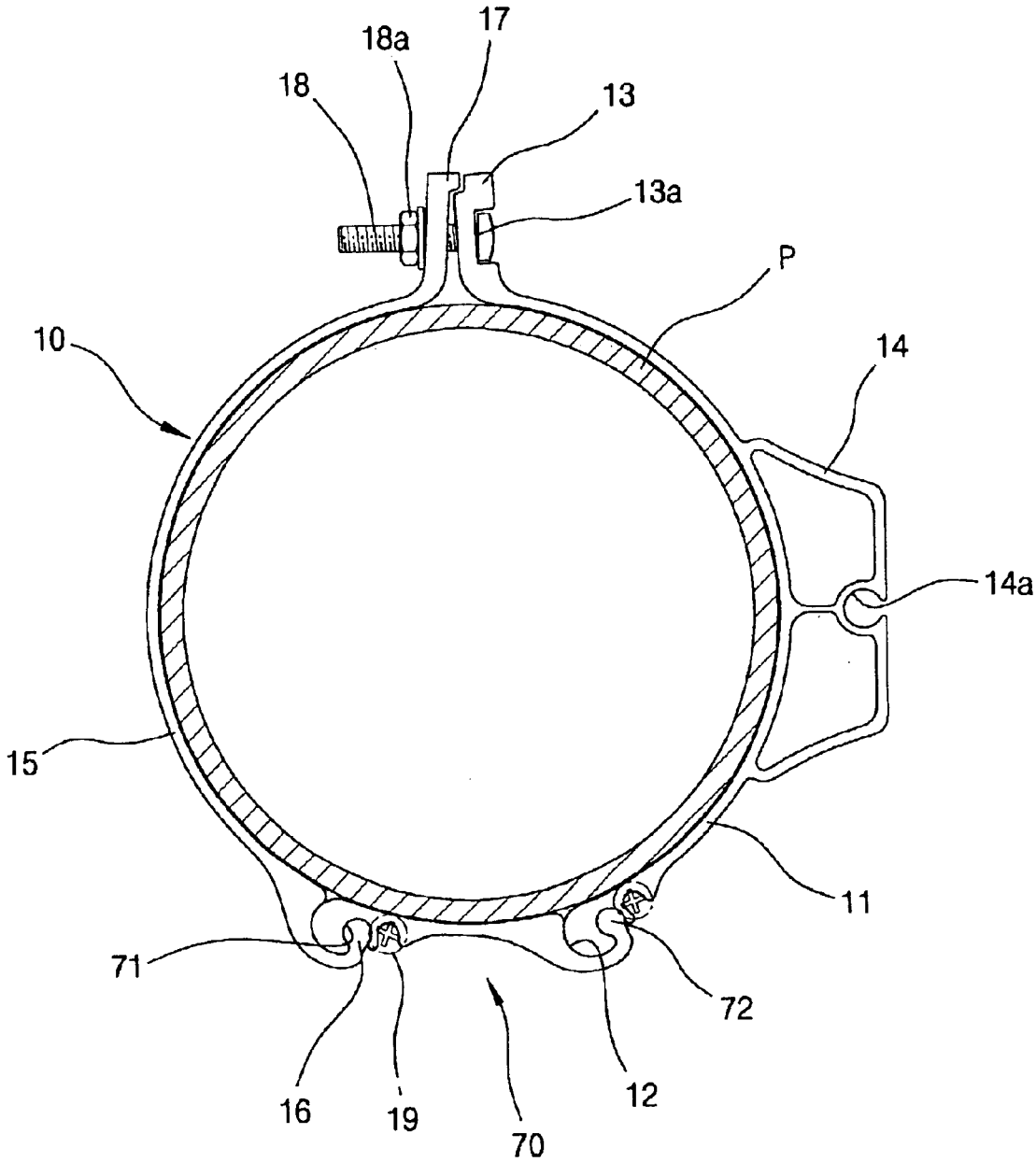
FIG. 11 is a plan view showing further embodiment of the post clamp according to the present invention.

FIG. 11 shows further embodiment of the post clamp 10 according to the present invention. This post clamp 10 is different from the previous embodiment in that it further includes at least an auxiliary clamping band 70, which is positioned between the first and second clamping bands 11 and 15 and is provided at its opposite ends with a hinge groove 71 and a hinge bulge 72, which correspond to the hinge bulge 16 and the hinge groove 12 of the first and second clamping band 11 and 15. Preferably, the auxiliary clamping band 70 has a circumference smaller than that of any of the first and second clamping bands.

According to this embodiment, since the first and second clamping bands 11 and 15 may be coupled to each other with the auxiliary clamping band 70 interposed there between in response to a diameter of the post "P", the post clamp 10 can be easily installed on various posts "P", regardless of a diameter of the post.

In the above-mentioned embodiments, the component of the traffic sign device may be manufactured from high strength synthetic resins, such as a reinforced plastic material, instead of nonferrous metal.

As described above, according to the traffic sign device of this invention, since the sign board can be easily installed on a post by a simple operation of placing the post clamp on the post and joining the movable pipe fixed to the sign board into the socket pipe fixed to the post clamp by bolts and nuts, an operation of installing the sign board is simplified.

Further, since the sign board is formed into a drum shape and the like and the joint portion relative to the support bar is positioned inside the sign board, the behind coupling part of the sign board is effectively shielded from a view. This allows the traffic sign device to have excellent structural strength as compared to the prior art sign device, and to have an acceptable appearance for a long time period, contributing to visual improvement of the cityscape.

According to the present invention, since associated components of the structure are manufactured from nonferrous metal excellent in corrosion resistance, it is possible to prevent rusting and corrosion of the component, thereby ensuring favorable appearance of the sign device as well as its extended service life.

Furthermore, according to further embodiment of this invention, the sign device can selectively adopt auxiliary clamping bands according to a diameter of a post, whereby the post clamp can be easily installed on the post.

Accordingly, the present invention has advantages in that working efficiency at a post site is improved, and extension of a service life of the sign device and beautification of a road environment are achieved.

Although preferred embodiments of the present invention have been described for illustrative purposes, those skilled in the art will appreciate that various modifications, additions and substitutions are possible, without departing from the scope and spirit of the invention as defined in the accompanying claims.

What is claimed is:

1. A traffic sign device, comprising:

a post clamp having at least two arched clamping bands, which are hingedly coupled to each other at their adjacent ends and joined to each other by a fastening element at their free ends to be installed on a post;

a support bar having a socket pipe radially joined to an outer surface of one of the clamping bands of the post clamp, the socket pipe being axially provided at its circumference with at least a joint hole, a movable pipe slidably inserted into the socket pipe, the movable pipe being axially provided at its circumference with a plurality of spaced adjustment holes, and a fastening means for coupling the movable pipe to the socket pipe through the joint hole and adjustment holes;

a sign board having an annular band frame with its both peripheral edges being formed a coupling groove, and a front and rear covers having a skirt formed along the peripheral edge of the respective covers to be fitted into and fastened to the coupling groove of the band frame; and a coupling unit for fastening the free end of the movable pipe of the support bar to the center portion of the rear cover of the sign board.

2. The traffic sign device as set forth in claim 1, wherein the coupling unit includes: an inner mounting plate made of ferrous metal attached to an inner side of the rear cover, the inner mounting plate being provided at the side portions with a plurality of taps to be inserted into the rear cover and fixed thereon; an outer mounting plate made of nonferrous metal having a diameter somewhat larger than that of the movable pipe, the outer mounting plate being concentrically joined to the free end of the movable pipe; and a fastening means for coupling the outer mounting plate to the rear cover and inner mounting plate.

3. The traffic sign device as set forth in claim 1, wherein the post clamp includes a rod-shaped contacting insert made of resilient material, the contacting insert being mounted at an inner surface of the post clamp to resiliently compress the post when the first and second clamping bands are coupled to each other around the post.

4. The traffic sign device as set forth in claim 2, wherein the fastening means is comprised of a bolt and a nut, in which the nut is preferably welded on the surface of the inner mounting plate.

5. The traffic sign device as set forth in claim 1, wherein the post clamp further includes at least one auxiliary clamping band coupled between the first and second clamping bands, which is provided at its opposite ends with a hinge groove and a hinge bulge corresponding to each other, whereby the auxiliary clamping band is selectively coupled between the first and second clamping bands according to a size of the post.

6. The traffic sign device as set forth in claim 5, wherein the post clamp includes a rod-shaped contacting insert made of resilient material, the contacting insert being mounted at an inner surface of the post clamp to resiliently compress the post when the first and second clamping bands are coupled to each other around the post.

7. The traffic sign device as set forth in claim 1, wherein the post clamp, the support bar and the sign board comprise a corrosion resistant nonferrous metal.

8. The traffic sign device as set forth in claim 2, wherein the rear cover is provided at the center portion thereof with a circular depression so as to safely receive the outer mounting plate of the coupling unit.

9. A traffic sign device, comprising:

a post clamp having at least two arched clamping bands, which are hingedly coupled to each other at their adjacent ends and joined to each other by a fastening element at their free ends so as to be installed on a post;

a support bar having a socket pipe radially joined to an outer surface of one of the clamping bands of the post clamp, the socket pipe being axially provided at its circumference with at least a joint hole, a movable pipe slidably inserted into the socket pipe, the movable pipe being axially provided at its circumference with a plurality of spaced adjustment holes, and a fastening means for coupling the movable pipe to the socket pipe through the joint hole and adjustment holes;

a sign board having a skirt formed along the peripheral edge thereof, for exhibiting a road sign attached to the front surface thereof; and a coupling unit for fastening the free end of the movable pipe of the support bar to the center portion of the rear cover of the sign board, the coupling unit having a bracket formed into a pan shape and fixed to the rear center portion of the sign board by welding so as to form a space from the sign board, the bracket being provided with a coupling nut at the bottom portion thereof, a connecting plate having a diameter larger than that of the movable pipe of the support bar, the connecting plate being joined to the free end of the movable pipe by welding, and a fastening means for joining the bracket to the connecting plate.

10. The traffic sign device as set forth in claim 9, wherein the post clamp includes a rod-shaped contacting insert made of resilient material, the contacting insert being mounted at an inner surface of the post clamp to resiliently compress the post when the first and second clamping bands are coupled to each other around the post.

11. The traffic sign device as set forth in claim 9, wherein the post clamp further includes at least one auxiliary clamping band coupled between the first and second clamping bands, which is provided at its opposite ends with a hinge groove and a hinge bulge corresponding to each other, whereby the auxiliary clamping band is selectively coupled between the first and second clamping bands according to a size of the post.

12. The traffic sign device as set forth in claim 11, wherein the post clamp includes a rod-shaped contacting insert made of resilient material, the contacting insert being mounted at an inner surface of the post clamp to resiliently compress the post when the first and second clamping bands are coupled to each other around the post.

13. The traffic sign device as set forth in claim 9, wherein the post clamp, the support bar, the sign hoard, and the coupling unit comprise a corrosion resistant nonferrous metal.

* * * * *